US010878731B2

(12) United States Patent
Koeppel et al.

(10) Patent No.: US 10,878,731 B2
(45) Date of Patent: Dec. 29, 2020

(54) MODULAR WALL ORGANIZATION SYSTEM

(71) Applicant: Continental Accessory Corporation, Jericho, NY (US)

(72) Inventors: Ronald Koeppel, Brookville, NY (US); Richard P. Koeppel, Palm Beach, FL (US); John Kraljic, Riverhead, NY (US)

(73) Assignee: Continental Accessory Corporation, Jericho, NY (US)

( * ) Notice: Subject to any disclaimer, the term of this patent is extended or adjusted under 35 U.S.C. 154(b) by 0 days.

(21) Appl. No.: 16/807,592

(22) Filed: Mar. 3, 2020

(65) Prior Publication Data

US 2020/0286411 A1 Sep. 10, 2020

Related U.S. Application Data

(60) Provisional application No. 62/814,052, filed on Mar. 5, 2019.

(51) Int. Cl.
*G09F 15/00* (2006.01)
*G09F 7/18* (2006.01)

(52) U.S. Cl.
CPC ..... *G09F 15/0012* (2013.01); *G09F 7/18* (2013.01); *G09F 2007/1843* (2013.01); *G09F 2007/1856* (2013.01)

(58) Field of Classification Search
CPC ..... A47G 1/065; A47G 1/101; A47G 1/102; G09F 15/0012; G09F 7/18; G09F 2007/1856; G09F 2007/1843; G09F 15/0062; G09F 15/56; Y10T 403/55; Y10T 403/553; Y10T 403/342; Y10T 403/347; A47F 5/0846; A47F 87/0223; A47F 87/0246; A47F 87/007; A47F 87/02; A47F 87/0276; F16B 5/0016; F16B 5/002; F16B 5/0092; F16B 5/0024; F16B 5/0004; F16B 5/0008; F16B 5/0012; F16B 5/06; F16B 5/0607; F16B 5/0621; A47B 47/0025; A47B 47/03; A47B 47/05; A47B 496/04
See application file for complete search history.

(56) References Cited

U.S. PATENT DOCUMENTS 3,070,914 A * 1/1963 Henderson ..... A47G 1/065 40/730
3,523,382 A * 8/1970 Dreyer ..... G09F 1/12 40/729
4,017,989 A * 4/1977 Murray ..... A47G 1/065 40/731

(Continued)

FOREIGN PATENT DOCUMENTS

DE 4035367 A1 * 5/1992 ..... E04B 2/7433

*Primary Examiner* — Cassandra Davis
(74) *Attorney, Agent, or Firm* — Caesar Rivise, PC

(57) ABSTRACT

A modular wall organization system, e.g., modular bulletin board system, including plural board assemblies. Each of the assemblies includes corner nodes which are configured to be connected to other corner nodes to enable the assemblies to be connected in various configurations on a wall either horizontally or vertically or horizontally and vertically. The assemblies may be framed or frameless. The systems also include clips and adhesive mounting pads for mounting the assemblies on a wall.

23 Claims, 11 Drawing Sheets

(56) References Cited

U.S. PATENT DOCUMENTS

| | | | | | |
|---|---|---|---|---|---|
| 4,115,938 | A * | 9/1978 | Belmuth | A47G 1/065 | 40/730 |
| 4,356,648 | A * | 11/1982 | Beaulieu | A47G 1/0605 | 40/757 |
| 5,046,791 | A * | 9/1991 | Kooiman | A47B 47/0025 | 312/265.1 |
| 6,230,428 | B1 * | 5/2001 | Albin | A47G 1/065 | 40/605 |
| 8,739,493 | B2 * | 6/2014 | Carnes | E04C 3/04 | 403/294 |

* cited by examiner

Fig. 2E
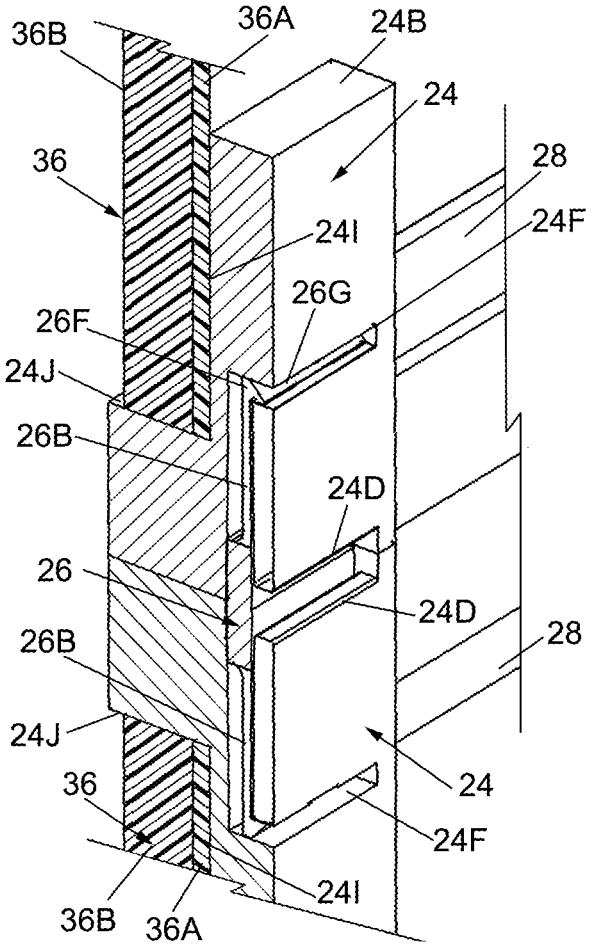
Fig. 2F
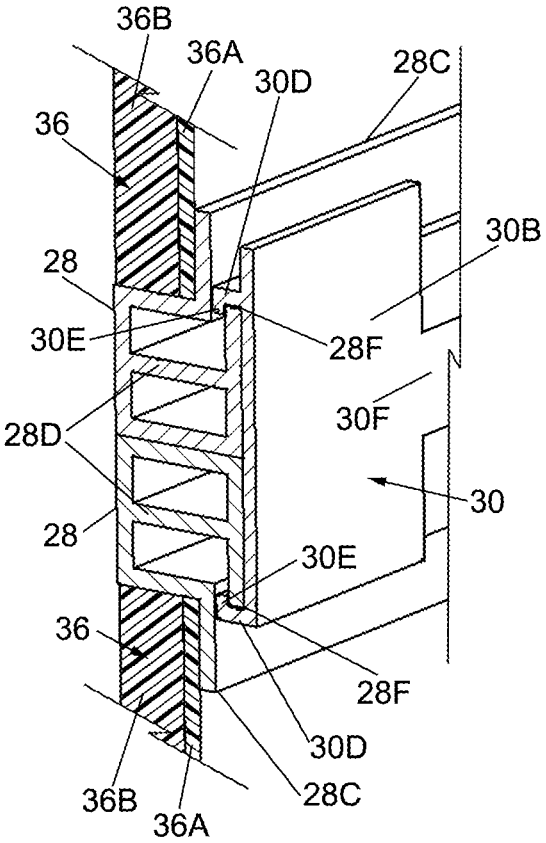
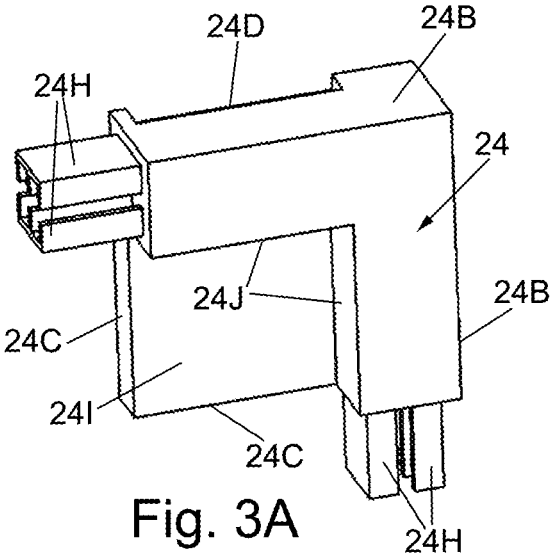
Fig. 3A
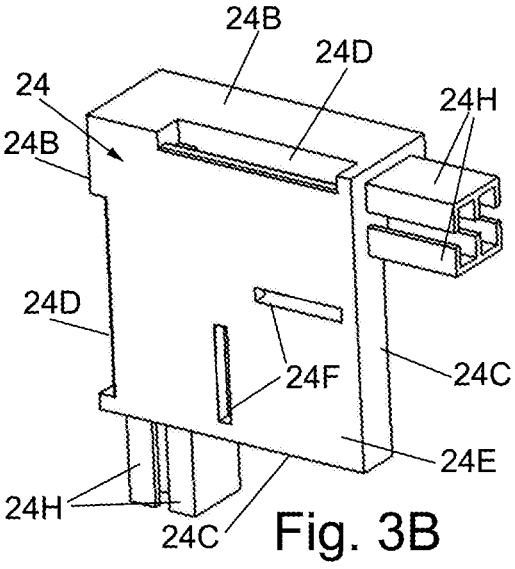
Fig. 3B

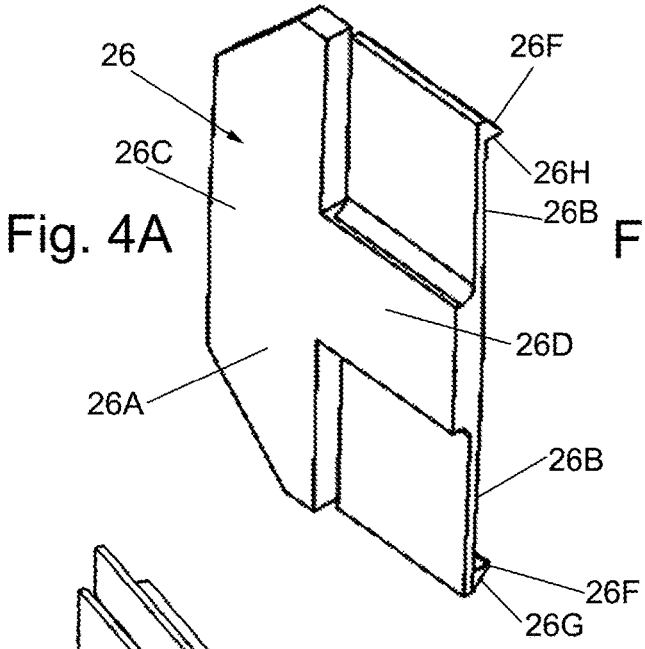
Fig. 4A
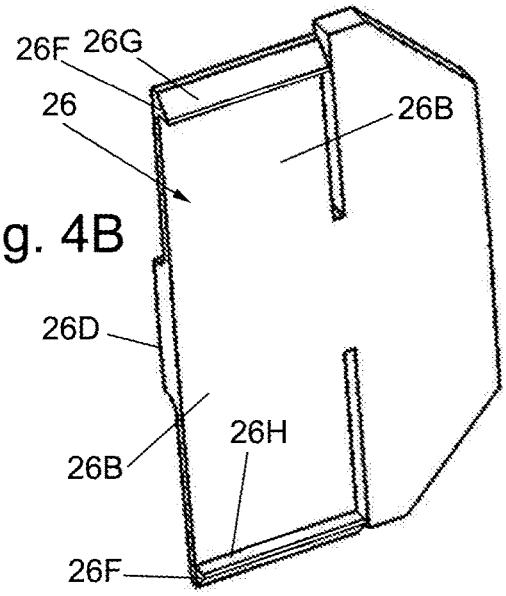
Fig. 4B
Fig. 6
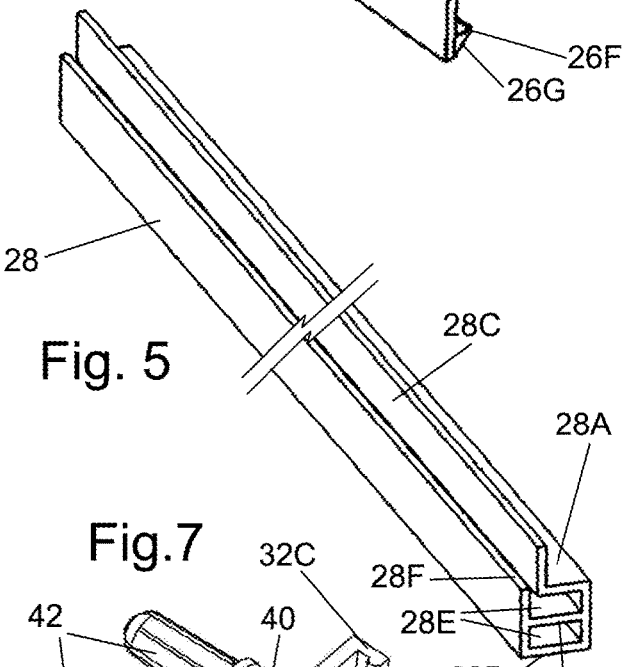
Fig. 5
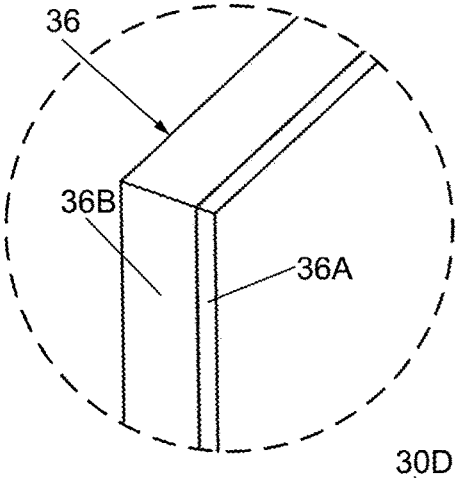
Fig.7
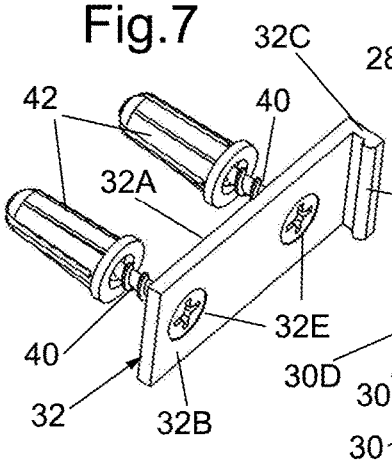
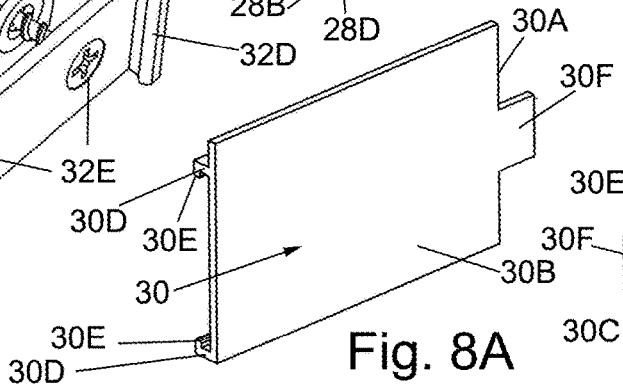
Fig. 8A
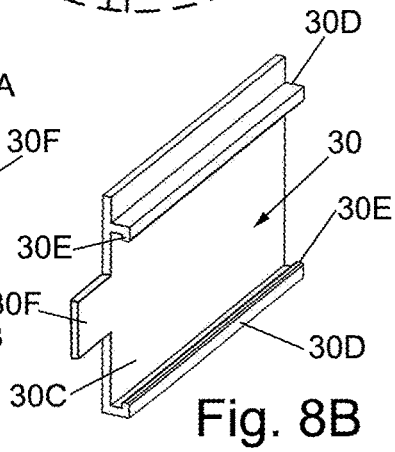
Fig. 8B

MODULAR WALL ORGANIZATION SYSTEM

CROSS-REFERENCE TO RELATED APPLICATIONS

This utility application claims the benefit under 35 U.S.C. § 119(e) of Provisional Application Ser. No. 62/814,052 filed on Mar. 5, 2019, entitled Modular Bulletin Board Systems. The entire disclosure of this provisional application is incorporated by reference herein.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

FIELD OF THE INVENTION

This invention relates generally to organization systems, e.g., bulletin boards, and more particularly to modular wall organization systems for mounting on a wall.

BACKGROUND OF THE INVENTION

Various bulletin boards are commercially available for mounting on a wall of a structure. The term "bulletin boards" is used herein as an example only of the many types of board applications that can be used to create a wall organization system of the subject invention. While prior art bulletin boards are generally suitable for their purposes, they aren't modular, nor do they provide a user with the ability to readily connect and disconnect a plurality of such boards together in various configurations and to be able to mount the assembled configuration of plural boards on a wall of a structure. Thus, a need exists for a modular wall organization system, e.g., a modular bulletin board system, which can readily connect plural various sized and/or shaped components, e.g., boards, to each other in various configurations, and which can be readily mounted on a wall and which may serve various functions, e.g., be a cork board, a dry eraser board, a chalk board, a mirror, a picture frame, a peg board, etc. The subject invention addresses that need.

All references cited and/or identified herein are specifically incorporated by reference herein.

SUMMARY OF THE INVENTION

One aspect of this invention is a modular wall organization system for mounting on a wall. The modular wall organization system comprises a first board component, a second board component, a first corner node member, a second corner node member, and at least one snap-connector. The first board component comprises a first planar panel having plural corners. The second board component comprises a second planar panel having plural corners. The first corner node member comprises a body having a back surface, a first side edge, a second side edge, a first channel, and a second channel. The first side edge of the first corner member extends at a predetermined angle to the second side edge of the first corner member. The first channel of the first corner member extends into the body of the first corner member from the first side edge of the first corner member. The second channel of the first corner member extends into the body of the first corner member from the second side edge of the first corner member. The second corner node member is located at one of the plural corners of the second planar panel. The second corner node member comprises a body having a back surface, a first side edge, a second side edge, a first channel, and a second channel. The first side edge of the second corner member extends at a predetermined angle to the second side edge of the second corner member. The first channel of the second corner member extends into the body of the second corner member from the first side edge of the second corner member. The second channel of the second corner member extends into the body of the second corner member from the second side edge of the second corner member. The at least one snap-connector has a first extending portion and a second extending portion. The first extending portion is configured for snap-fitting into one of the first and second channels of the first corner node. The second extending portion is configured for snap-fitting into one of the first and second channels of the second corner node to secure the first corner node to the second corner node.

In accordance with one preferred aspect of the modular wall organization system the first corner node member additionally comprises a first slot and a second slot. The second corner node member additionally comprises a first slot and a second slot. The first slot of the first corner node member is located in the back surface of the first corner node member and in communication with the first channel of the first corner node member. The second slot of the first corner node member is located in the back surface of the first corner node member and in communication with the second channel of the first corner node member. The first slot of the second corner node member is located in the back surface of the second corner node member and in communication with the first channel of the second corner node member. The second slot of the second corner node member is located in the back surface of the second corner node member and in communication with the second channel of the second corner node member.

In accordance with another preferred aspect of the modular wall organization system of this invention the at least one snap connector includes one flexible tab having a flanged free end and another flexible tab having a flanged free end. The one flexible tab is configured for receipt in the first channel of the first corner node member with the flanged free end of the one flexible tab being located in the first slot of the first corner node member. The other flexible tab is configured for receipt in the first channel of the second corner node member with the flanged free end of the other flexible tab being located in the first slot of the second corner node member.

In accordance with another preferred aspect of the modular wall organization system of this invention the at least one snap connector includes one flexible tab having a flanged free end and another flexible tab having a flanged free end. The one flexible tab is configured for receipt in the second channel of the first corner node member with the flanged free end of the one flexible tab being located in the second slot of the first corner node member. The other flexible tab is configured for receipt in the second channel of the second corner node member with the flanged free end of the other flexible tab being located in the second slot of the second corner node member.

In accordance with another preferred aspect of the modular wall organization system of this invention the system additionally comprises a clip for securement to the wall to mount the bulletin board system thereon. The clip is configured for engagement with one of the first and second corner nodes.

In accordance with another preferred aspect of the modular wall organization system of this invention the clip includes a flexible tab having a flanged free end configured for snap-fitting receipt in one of the first or second channels of one of the first and second corner nodes.

In accordance with another preferred aspect of the modular wall organization system of this invention the system additionally comprises an adhesive or VELCRO pad for securement to the wall to mount the bulletin board system thereon. The adhesive or VELCRO pad is configured for securement to the back surface of the body of one of the first and second corner nodes.

In accordance with another preferred aspect of the modular wall organization system of this invention the first bulletin board additionally comprises a first frame, and the second bulletin board additionally comprises a second frame.

In accordance with another preferred aspect of the modular wall organization system of this invention the first frame includes two sections which are connected together by the first corner node, and wherein the second frame includes two sections which are configured to be connected together by the second corner node.

In accordance with another preferred aspect of the modular wall organization system of this invention each of the sections of the first frame includes a hollow end. The first corner node member comprises a pair of projections configured to be received within respective ones the hollow ends of the sections of the first frame. Each of the sections of the second frame includes a hollow end. The second corner node member comprises a pair of projections configured to be received within respective ones the hollow ends of the sections of the second frame.

In accordance with another preferred aspect of the modular wall organization system of this invention the first panel and/or the second panel includes an outer surface formed from one or more of the following: a cork panel, a dry erasable material panel, a chalk receiving material panel, a mirror panel, a panel formed of a material capable of being written upon, a peg board panel, a panel bearing some indicia or graphics, a panel formed of a fabric, and a panel formed metal capable of having a magnetic item releasably mounted thereon.

In accordance with another preferred aspect of the modular wall organization system of this invention the system additionally comprises a connector clip configured for releasably connecting the first frame to the second frame. The connector clip comprises a thin planar body from which a pair of flanged rails project. One of the flanged rails is configured for snap-fitting engagement with a respective portion of the first frame. The other of the flanged rails is configured for snap-fitting engagement with a respective portion of the second frame.

In accordance with another preferred aspect of the modular wall organization system of this invention the connector clip comprises a tab projecting outward from a side thereof. The tab is configured to serve as a tool for disconnecting the first corner node from the second corner node.

DESCRIPTION OF THE DRAWING

FIG. 2E is an enlarged sectional isometric view taken along line 2E-2E of FIG. 2A;

FIG. 2F is an enlarged sectional isometric view taken along line 2F-2F of FIG. 2A;

FIG. 3A is an enlarged isometric view showing the front of a corner node component forming a portion of the system of FIG. 1;

FIG. 3B is an enlarged isometric view of the corner node shown in FIG. 3A, but taken from a different angle showing the rear thereof;

FIG. 4A is an enlarged isometric view showing the front of a corner node snap-connector component forming a portion of the system of FIG. 1;

FIG. 4B is an enlarged isometric view of the corner node snap-connector component shown in FIG. 4A, but taken from a different angle showing the rear thereof;

FIG. 5 is an enlarged isometric view of a frame member forming another component of the system of FIG. 1;

FIG. 6 is an enlarged isometric view of a portion of a bulletin board panel forming another component of the system of FIG. 1;

FIG. 7 is an enlarged isometric view of the wall mount clip component shown in FIG. 2B;

FIG. 8A is an enlarged isometric view showing the front of a connector clip component forming another portion of the system of FIG. 1;

FIG. 8B is an enlarged isometric view of the connector clip component shown in FIG. 8A, but taken from a different angle showing the rear thereof;

DETAILED DESCRIPTION OF THE PREFERRED EMBODIMENT

Figure 1:
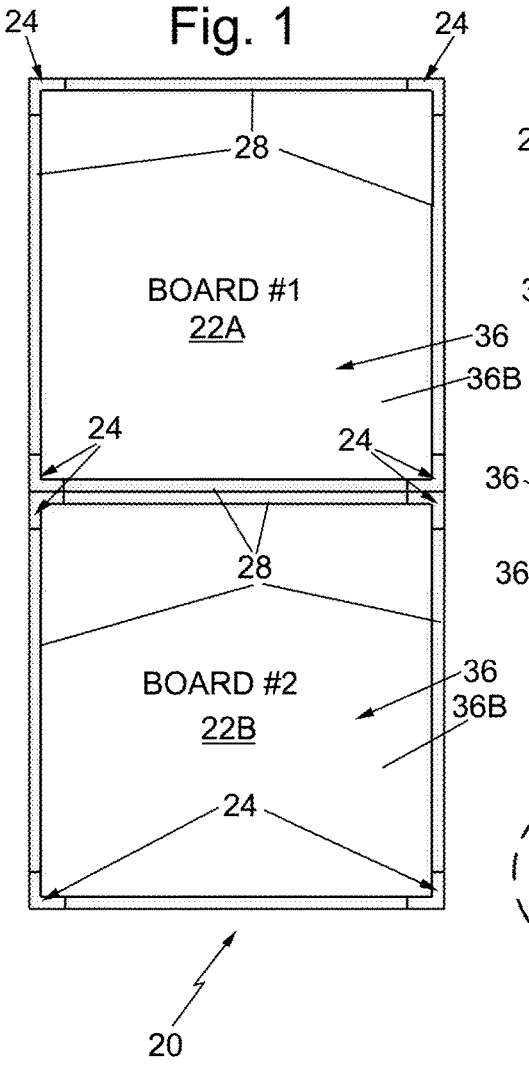
FIG. 1 is a front elevation view of one exemplary embodiment of a wall organization system, e.g., a bulletin board system, constructed in accordance with this invention, the bulletin board system making use of two identical size framed bulletin board assemblies.

Referring now to the various figures of the drawing wherein like reference characters refer to like parts, there is shown at 20 in FIG. 1 one exemplary embodiment of a modular wall organization system constructed in accordance with this invention. It should be noted that the exemplary wall organization system 20 shown in FIG. 1 is in the form of a modular bulletin board system. That is merely exemplary, since systems of this invention are not limited to bulletin board systems and can be constructed and configured for mounting and arranging any type, shape or size board component (e.g., cork boards, dry erase boards, chalk boards, peg boards, mirrors, fabric panels, metal panels, acrylic panels, picture frames, etc.) on a wall. Moreover, the system 20, like the other systems constructed in accordance with this invention, includes plural modular board assemblies, which are constructed so that they can be arranged vertically and/or horizontally.

The exemplary embodiment 20 includes two bulletin board assemblies, namely "Board #1", designated by the reference number 22A and "Board #2", designated by the reference number 22B, but could if desired include more than two of such board assemblies.

Figure 10:
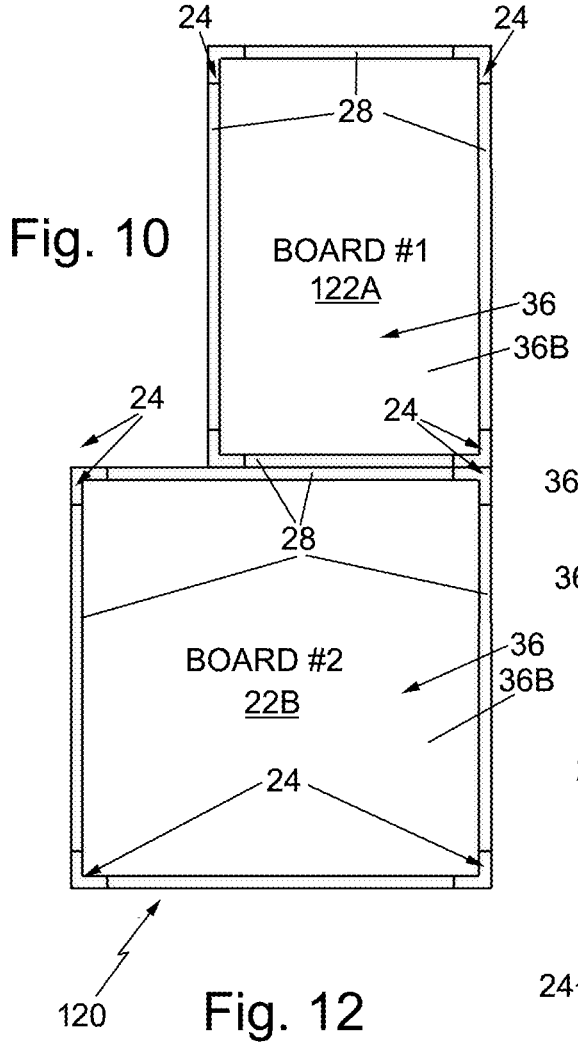
FIG. 10 is a front elevation view of another exemplary embodiment of a bulletin board system constructed in accordance with this invention, the bulletin board system making use of two different size framed bulletin board assemblies.
Figure 11:
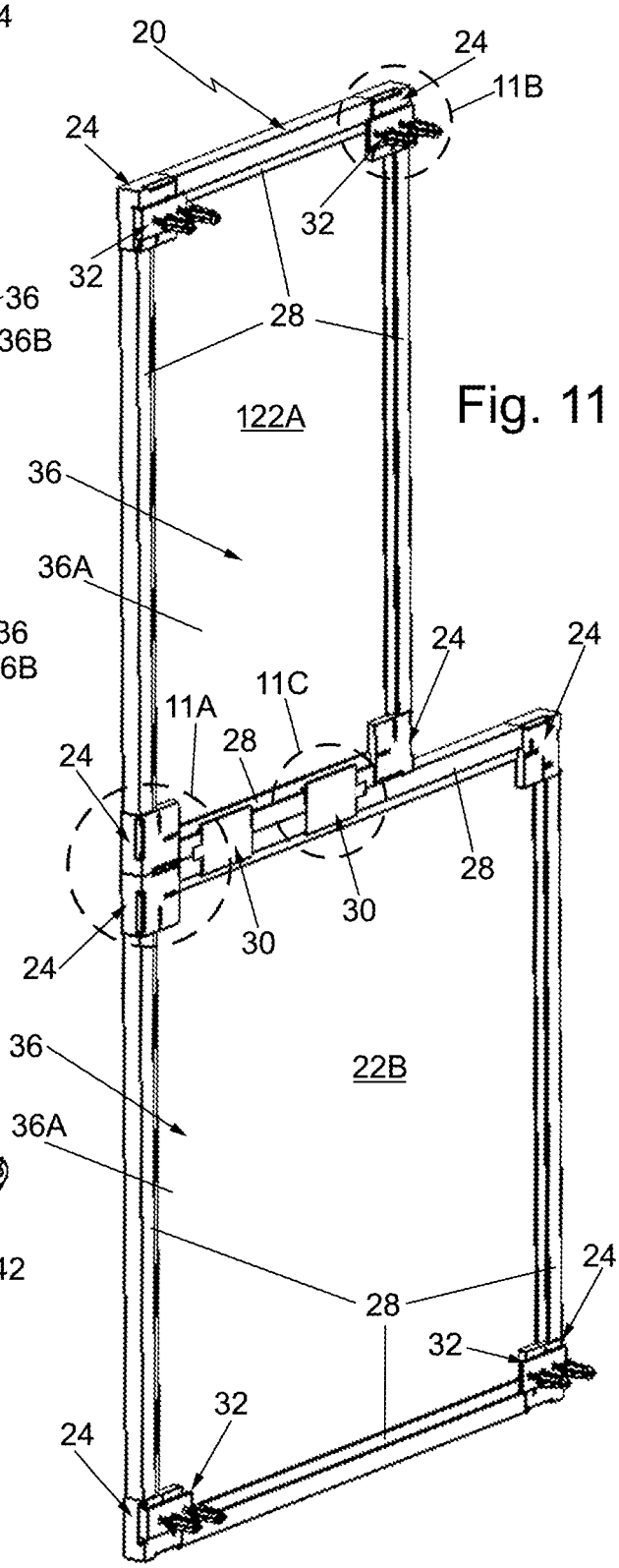
FIG. 11 is an enlarged isometric view of the rear side of the bulletin board system shown in FIG. 10, showing the bulletin board system as it would be mounted on a wall using wall mount clips forming a portion of the system.
Figure 11A:
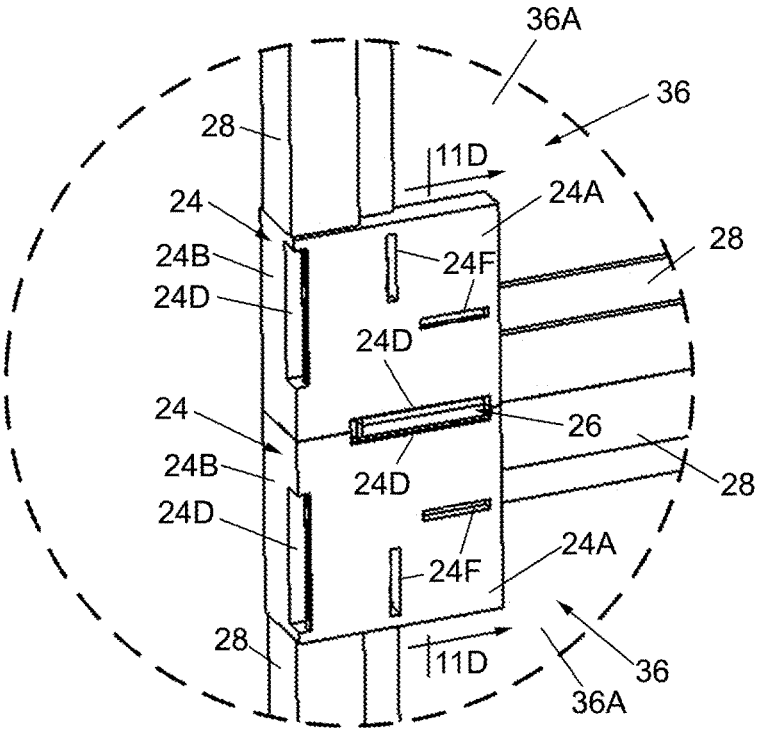
FIG. 11A is an enlarged isometric view of the portion of the bulletin board system shown within the broken circle designed by the reference number 11A in FIG. 11.
Figure 11B:
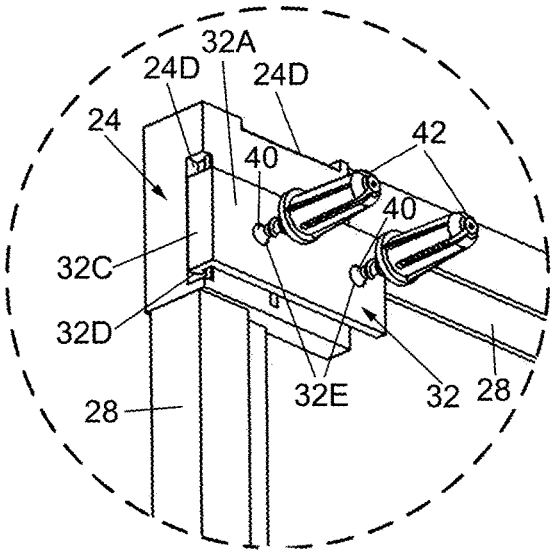
FIG. 11B is an enlarged isometric view, similar to FIG. 2A, of the portion of the bulletin board system shown within the broken circle designed by the reference number 11B in FIG. 11, showing one wall mount clip.
Figure 11C:
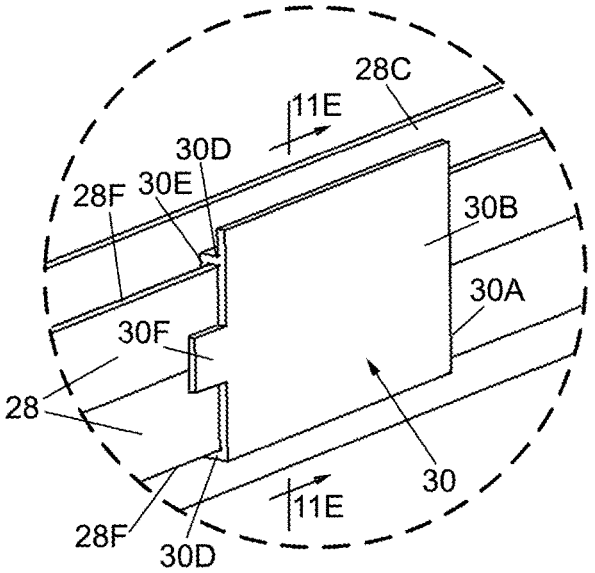
FIG. 11C is an enlarged isometric view of the portion of the bulletin board system shown within the broken circle designed by the reference number 11C in FIG. 11.
Figure 11D:
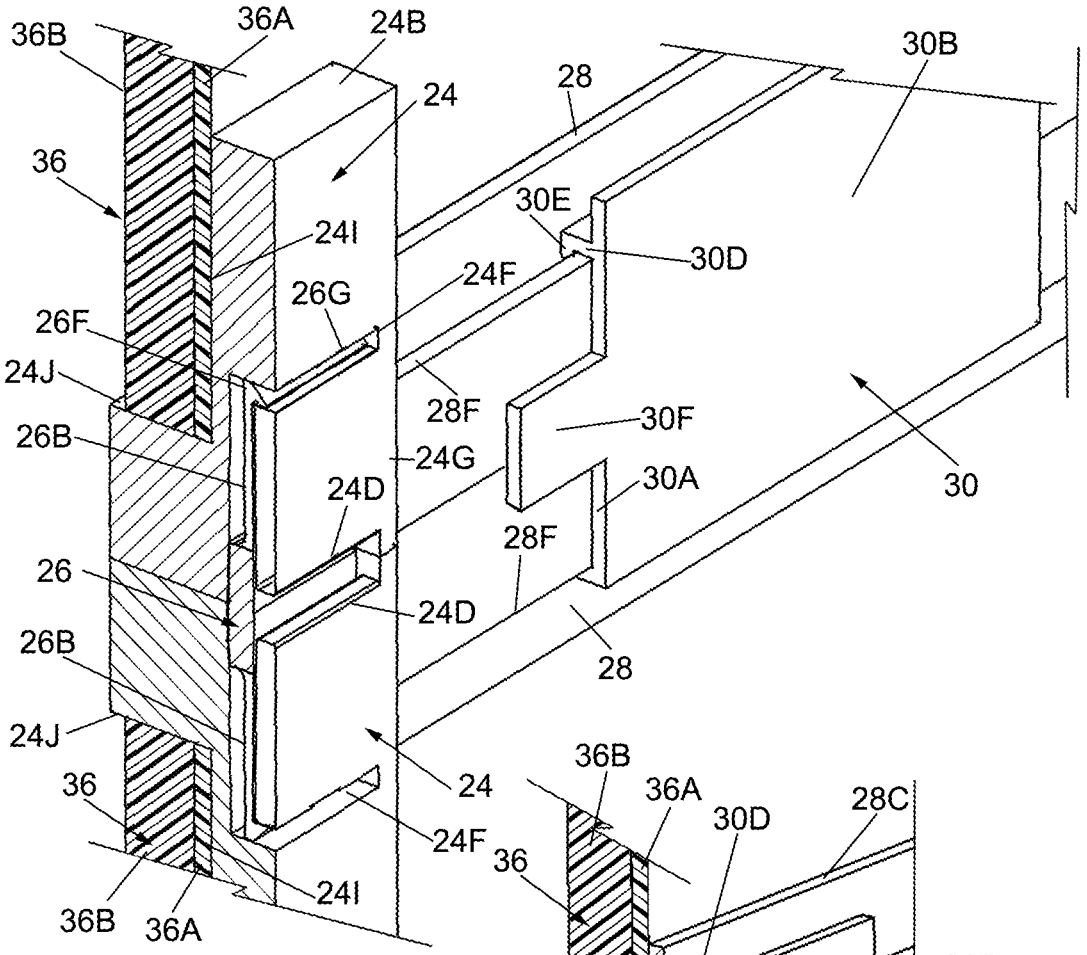
FIG. 11D is an enlarged sectional isometric view taken along line 11D-11D of FIG. 11A.
Figure 11E:
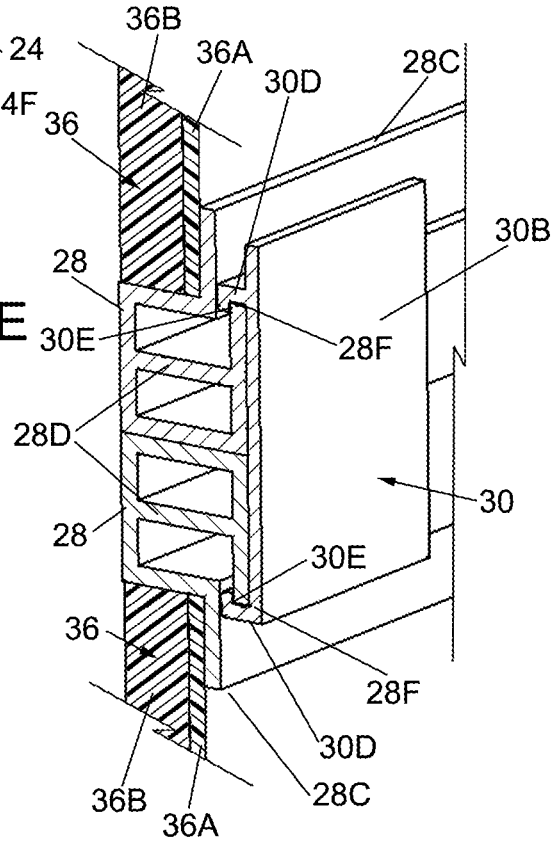
FIG. 11E is an enlarged sectional isometric view taken along line 11E-11E of FIG. 11C.

The two board assemblies are shown in FIG. 1 as being oriented with the board assembly 22A is located vertically above the board assembly 22B. The board assemblies 22A and 22B are of the same size, e.g., 16 inches by 16 inches. That need not be the case. Thus, systems of this invention may be provided to include plural modular bulletin board assemblies of different sizes so that they can be mixed and matched as desired. One such exemplary mixed size system is shown in FIGS. 10 and 11 and will be described later. It includes one rectangular board assembly of 12 inches by 16 inches and one square board assembly of 16 inches by 16 inches. Those sizes and shapes are merely exemplary and thus the bulletin board assemblies can be square, rectangular or otherwise in sizes greater than or less than the examples of FIGS. 1 and 10. Irrespective of their size and shape the bulletin board assemblies of this invention are configured to snap together using modular clips constructed in accordance with this invention so that a user can create unlimited configurations for mounting on a wall of a building or other structure. In the interest of drawing simplicity the wall on which the systems of this invention are to be mounted is not shown.

In addition to the bulletin board assemblies 22A and 22B the system 20 basically comprises plural corner nodes 24, plural corner node snap connectors 26, plural frame sections 28, plural connector clips 30, plural wall mount clips 32, and plural wall mount adhesive pads 34. Each bulletin board assembly comprises a bulletin board panel 36 and a surrounding frame composed of four frame sections 28 connected together by four corner nodes 24. The bulletin board panel 36 is a generally planar member of any desired size. In the embodiment of FIG. 1 each panel 36 is of square shape. As will be described later the embodiment of FIG. 10 includes one panel of square shape and one panel of rectangular shape.

As best seen in FIGS. 1 and 6, the panels 36 include a base layer 36A and a face layer 36B. The base layer 36A can be formed of any suitable rigid material, e.g., plastic, fiberboard, particle board, etc. The face layer 36B is secured on the base layer and can be formed of any suitable material typically used as the surface of a bulletin board, e.g., cork, a dry eraser sheet, a chalk board, a fabric board, a metal board to releasably secure a magnetic item thereon, etc. Thus, each bulletin board may provide a different appearance and may be suitable for different uses. For example, one of the bulletin board assemblies of the system 20 may be constructed using cork as the face layer to serve as a cork board, while another bulletin board assembly may be constructed using a dry eraser sheet as the face layer to serve as an erasable bulletin board. Thus, any particular configuration of bulletin board assemblies which are connected together and which are mounted on a wall may provide different functions for the user.

Each of the frame sections 28 making up the frame for the bulletin board panel is an elongated linear member formed of any suitable rigid material, e.g., preferably metal. If the frame sections are of a short length and the materials making up the panel 36 are light in weight the frame members may be formed of a plastic material. The frame sections may be formed as an extrusion or by molding, depending upon the material used. In any case as best seen in FIG. 5, each frame section 28 is of a hollow construction of generally square cross section including an inner wall 28A, an outer wall 28B, a flange 28C, and an intermediate wall 28D. The flange 28C projects perpendicularly from the inner wall 28A. The inner wall 28A serves to engage a respective one of the edge of the panel 36, with the flange 28C overlying the portion of the panel contiguous with that edge. The intermediate wall 28D extends the length of the section between the inner wall 28A and the outer wall 28B to form two rectangular passageways 28E extending the entire length of the frame section. Each of the passageways is open at each end of the frame section to receive respective portions of a corner node 24 to effect the connection of one of the frame sections to another frame section. Each frame section 28 also includes a free edge 28F which extends parallel to and slightly spaced from the flange 28C. The free edge 28F of each frame section serves as a means for connecting a portion of a connector clip 30 to it, if desired. Thus, as will be described later the connector clip can be used to connect one frame section of the bulletin board assembly 22A to a frame section of the bulletin board assembly 22B. Where the bulletin board assembly 22A and the bulletin board assembly 22B are the same size like shown in FIG. 2, connector clips may not be necessary. Where the bulletin board assemblies 22A and 22B are of different shapes or sizes from each other, such as shown in FIGS. 10 and 11, the connector clips 30 are more likely to be used.

Turning now to FIGS. 3A and 3B, the details of the corner nodes 24 will now be described. Each corner node is formed of any suitable rigid material, e.g., metal or plastic, and can be formed as an extrusion or by molding. In any case the corner node has a generally square shaped body 24A having two outside edges 24B which are planar and which extend perpendicularly to each other. One of the outside edges is horizontal and one vertical. The corner node also includes two inside edges 24C which are planar and extend perpendicularly to each other, with one of those inside edges being horizontal and one vertical. A channel 24D extends into the body from each of the outside edges. Each channel 24D terminates at an opening in communication with the back surface 24E of the body 24A. Each slot 24F extends parallel to the outside edge 24B from which the associated channel 24D extends. Each slot 24F is configured to receive a tab (to be described later) of a corner node snap-connector 26. Each of the inner edges 24C of the body 24A includes a pair of projections 24H which are of generally E-shape in cross section. Each of the projections 24H is configured to be tightly received within respective passageway 28E of a frame section to secure the frame section to a corner node.

The four frame sections 28 making up the frame are connected to one another by respective ones of the four corner nodes 24 to complete the frame. The frame serves to enclose and support the bulletin board panel 36 within its confines. The front surface of the body 24A of each corner node contiguous with the inner edges 24C thereof is designated by the reference number 241 and serves to receive the back surface of the base panel 36A. The body 24A of each corner node also includes two planar ledge surfaces 24J extending perpendicularly to each other for engaging respective side edges of the bulletin board panel 36 when the bulletin board panel 36 is mounted on the frame.

As mentioned earlier the connection of the frame assemblies to one another is accomplished by use of the corner node snap connectors 26. FIGS. 4A and 4B show one such corner node snap connector 26. Each corner node snap connector is formed of any suitable material, e.g., metal or plastic, and can be formed as an extrusion or by molding. In any case the corner node snap connector basically comprises a thin generally planar body 26A from which a pair of flexible tabs 26B project in opposite directions from each other. As best seen in FIG. 4A, the front surface 26C of the body 26A is planar and is of a generally truncated arrowhead shape, with a portion 26D thereof from which the tabs 26B extend. The rear surface 26E of the body is planar, with the rear surface of each of the tabs being coplanar with the rear surface of the body. The free end of each of the tabs 26B terminates in a wedge-shaped flange 26F. Each wedge-shaped flange has a sloped surface 26G and a contiguous undercut surface 26H. Each tab is sized and shaped to extend into a respective one of the channels 24D of a corner node 24 so that the flange 26F on the tab will snap fit into the immediately adjacent slot 24F of the corner node.

Figure 9A:
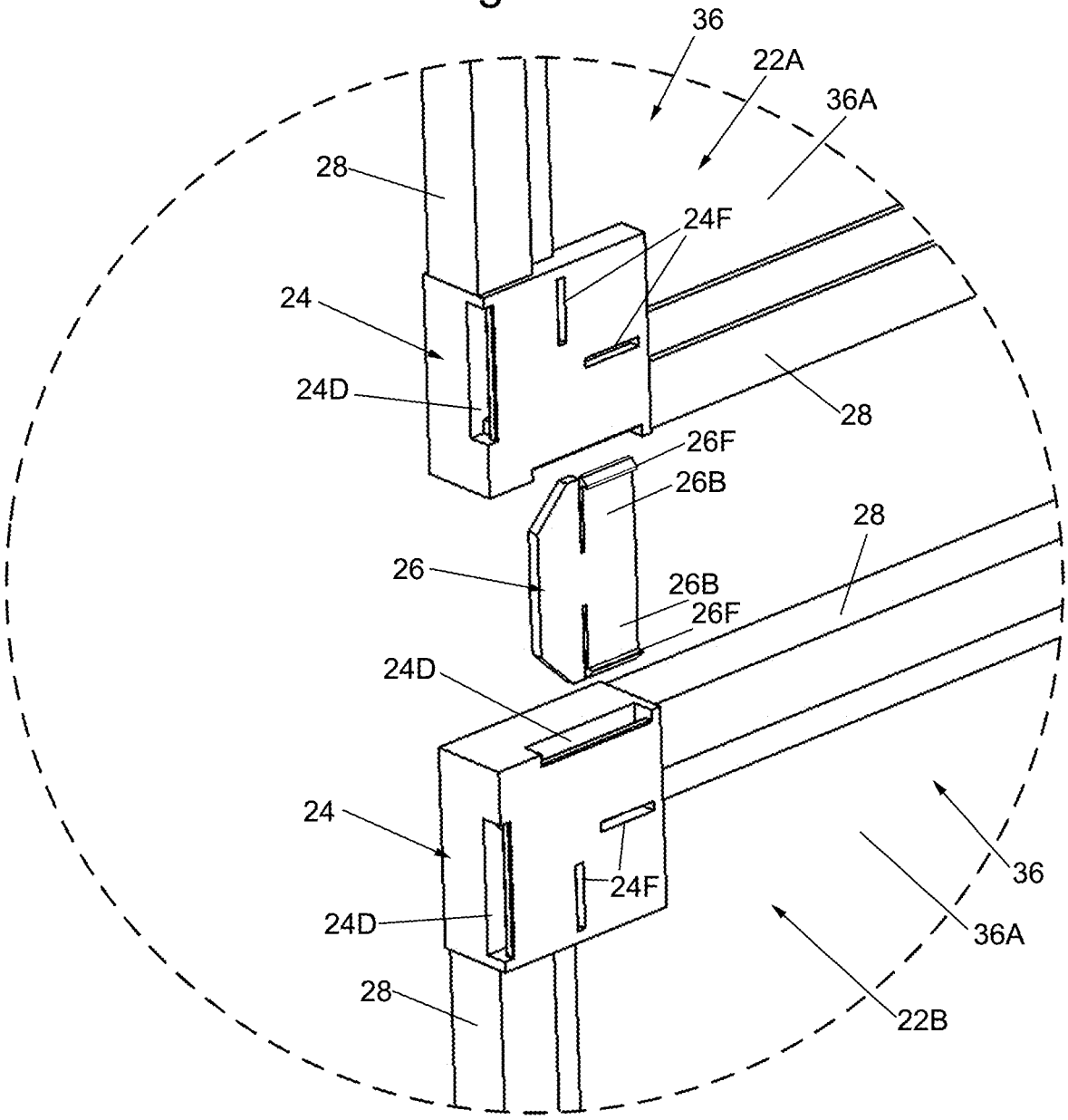
FIG. 9A is an enlarged isometric view showing a corner node snap connector in the process of connecting two corner node components mounted on two bulletin boards of the subject invention to connect the bulletin boards together.

The connection of the bulletin board assemblies 22A and 22B of the system 20 in the configuration shown in FIG. 1 will now be described. In particular, FIG. 9A shows the system of FIG. 1, with two bulletin board assemblies 22A and 22B about to have the corner node 24 of the lower left corner of the assembly 22A connected to the corner node 24 in the upper left corner of the assembly 22B by a corner node connector 26. The corner node 24 in the lower right corner of the assembly 22A is connected to the corner node 24 in the upper right corner of the assembly 22B by another corner node connector 26 in the same manner and at the same time but will not be described in the interest of brevity.

Figure 2:
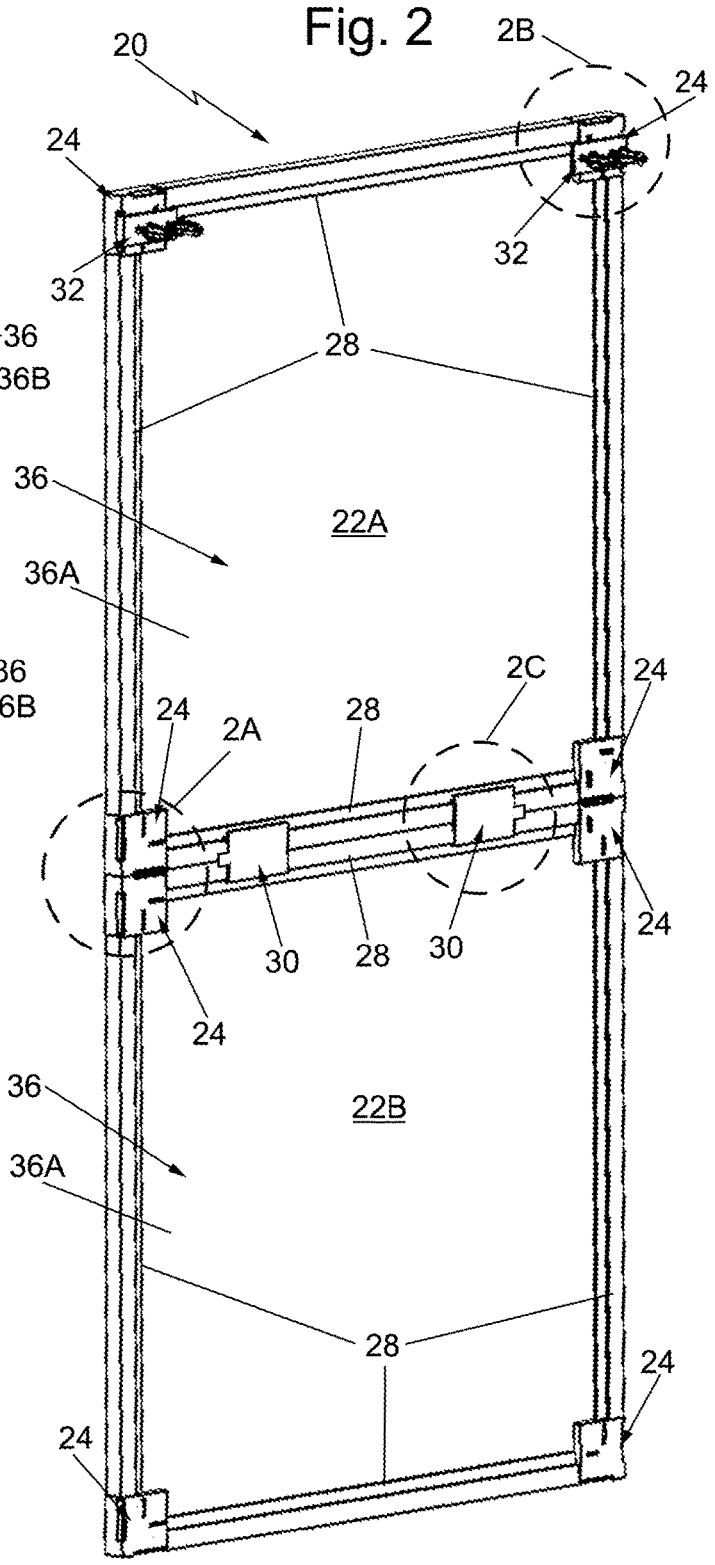
FIG. 2 is an enlarged isometric view of the rear side of the bulletin board system shown in FIG. 1, showing the bulletin board system as it would be mounted on a wall using wall mount clips forming a portion of the system.
Figure 2A:
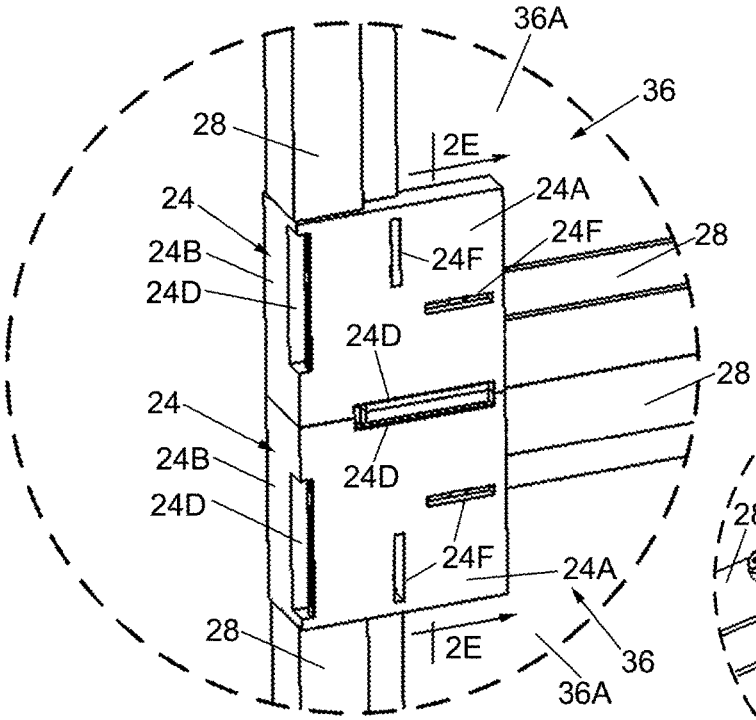
FIG. 2A is an enlarged isometric view of the portion of the bulletin board system shown within the broken circle designed by the reference number 2A in FIG. 2.
Figure 9B:
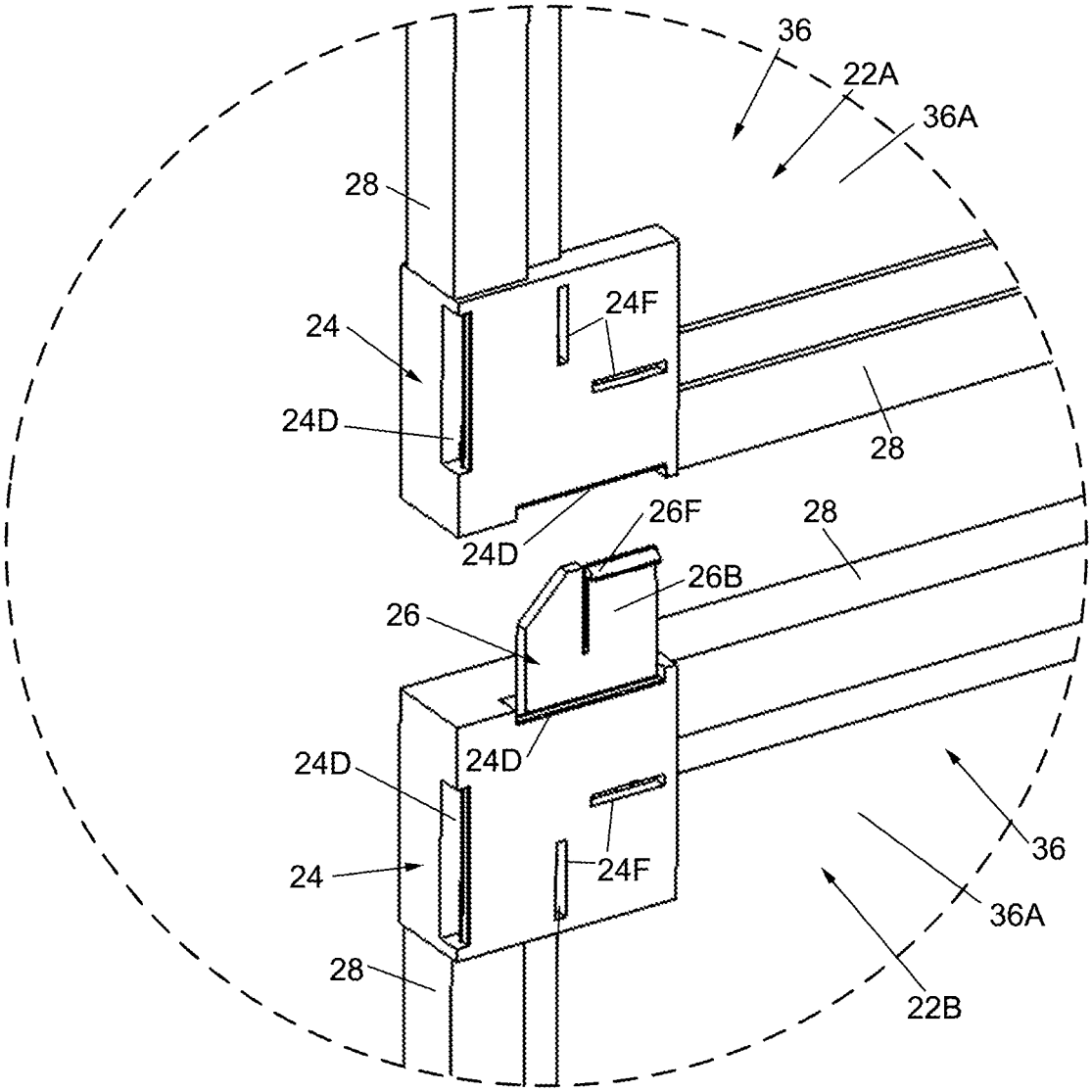
FIG. 9B is an enlarged isometric view, like that of FIG. 9A, but showing the corner node snap connector connected to one of the corner node components and in the process of being connected to the other of the corner node components to connecting those two corner node components to each other to connect the bulletin boards together.

Thus, as can be seen in FIG. 9A the connection of the corner node 24 of the lower left corner of the assembly 22A is connected to the corner node 24 in the upper left corner of the assembly 22B by a corner node connector 26 as follows. The corner node connector 26 is juxtaposed so that the downwardly extending tab 26B is aligned with the upwardly facing channel 24D that is in communication with the horizontally oriented side of the corner node 24 in the upper left corner of the bulletin board assembly 22B. That corner node connector 26 is then moved downward so that it enters into the channel 24D with the sloped surface 26G of the wedge shaped flange of the downwardly extending tab 26B engaging the inner surface of that channel to cause that tab to flex inward until the undersurface 26H of its flange reaches the slot 24F. At that point the tab 26B will flex outward to its normal position, with the wedge shaped flange 26F snapping into the slot 24F as shown in FIG. 9B. The corner node 24 in the lower left corner of the bulletin board assembly 22A can then be connected to the snap connector 26 by moving the bulletin board assembly 22B and/or the bulletin board assembly 22A with respect to each other so that the upwardly extending tab 26B of the corner node connector 26 is aligned with the downwardly facing channel 24D that is in communication with the horizontally oriented side of the corner node 24 in the lower left corner of the bulletin board assembly 22A. The bulletin board assembly 22A and/or the bulletin board assembly 22B are then moved relative to each other so that the upwardly extending tab 26B enters into the downwardly facing channel 24D, with the sloped surface 26G of the wedge shaped flange of the upwardly extending tab engaging the inner surface of that channel to cause that tab to flex inward until the undersurface 26H of its flange reaches the slot 24F. At that point the tab will flex outward to its normal position, with the wedge shaped flange snapping into the slot 24F as shown in FIG. 2A. This locks the corner nodes together via the corner node connectors.

If it is desired to disconnect the corner nodes from each other to disconnect the bulletin board assemblies 22A and 22B from each other, that can be accomplished by inserting a tool, e.g., a screw driver or a tab 30F of a connector clip 30 (to be described later), into the slot 24G and pressing upon the tab 28 to cause it to flex inward, thereby freeing the wedge-shaped flange from the slot 24F to enable the snap connector 26 to be pulled out of the channel 24D.

It should be pointed out at this juncture that instead of connecting the bulletin board assemblies 22A and 22B vertically (e.g., assembly 22A being located over assembly 22B), those assemblies can be connected side-by-side. That is accomplished in the same manner as described above, except that the channels contiguous with the vertically extending sides of the corner nodes will be used by the corner node connector 26 instead of using the channels contiguous with the horizontally extending sides of the corner nodes as described above.

In order to enhance the rigidity of the connection of the bulletin board assembly 22A to the bulletin board assembly 22B one frame section of the bulletin board assembly 22A is configured to be connected to another frame section of the bulletin board assembly 22B by a connector clip 30. In fact, as can be seen in FIG. 2, frame sections of the two bulletin board assemblies are connected together by means of two connector clips 30. That is merely exemplary. Thus, the two assemblies 22A and 22B may be connected together by use of only one connector clip 30. In fact, if the bulletin board assemblies are sufficiently small and the frame sections sufficiently rigid, no connector clip 30 need be used, e.g., the connection of the two corner nodes 24 of one assembly to two corner nodes of the other assembly being sufficient to hold those assemblies together.

Each connector clip 30 is formed of any suitable rigid material, e.g., metal or plastic, and can be formed as an extrusion or by molding. One connector clip 30 is shown in FIGS. 8A and 8B and basically comprises a thin generally planar body 30A having planar back surface 30B and a planar front surface 30C. The front surface includes a pair of rails 30D extending along the length of the connector clip. Each rail terminates in a flanged free edge 30E. One of the side edges of the planar body A includes the heretofore identified tab 30F. In particular, that tab is of the same thickness as the body from which it projects and is of a width enabling it to be inserted into any of the slots 24F to disconnect one bulletin board assembly from another bulletin board assembly, as will be described later.

Figure 2B:
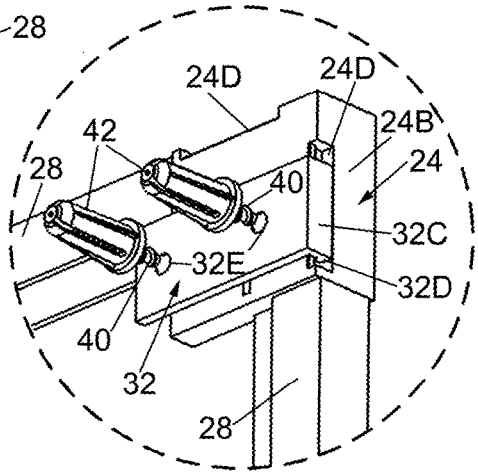
FIG. 2B is an enlarged isometric view of the portion of the bulletin board system shown within the broken circle designed by the reference number 2B in FIG. 2, showing one wall mount clip.
Figure 2C:
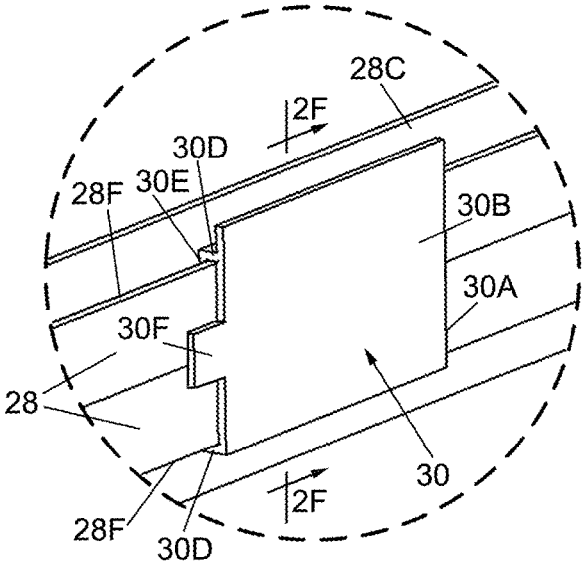
FIG. 2C is an enlarged isometric view of the portion of the bulletin board system shown within the broken circle designed by the reference number 2C in FIG. 2.

As best seen in FIG. 2C one of the rails 30D extends along the lower edge of the connector clip and one of the rails 30D extends along the upper edge of the connector clip. In the embodiment of FIGS. 1 and 2 each of the connector clips 30 serves to connect the frame section 28 at the bottom of the bulletin board assembly 22A to the frame section 28 at the top of the bulletin board assembly 22B. The manner of such a connection will now be described with reference to one of the connector clips 30, it being understood that the connection of the other connector clip is accomplished in an identical manner. Thus, the connector clip 30 is juxtaposed so that the front surface of it faces the portions of the two frame sections to be connected. The connector clip is then pushed toward the two frame sections, whereupon the flange on the free edge 30E the upper rail 30D engages the upwardly extending free edge 28F of the frame section 28 of the bulletin board assembly 22A. At the same time the flange on the free edge 30E the lower rail 30D engages the downwardly extending free edge 28F of the frame section 38 of the bulletin board assembly 22B. This action causes the connector clip's body to flex and its rails to spread apart slightly from each other, whereupon the flange on the free edge of the upper rail snaps over the free edge 28F of the frame section of the assembly 22A and into the space between the free edge 28F and the flange 28C as shown in FIG. 2F while the flange on the free edge of the lower rail snaps over the free edge 28F of the frame section 28 of the assembly 22B. This connects the two frame sections together.

Each connector clip 30 can be disconnected from the frame sections by grasping portions of it contiguous with its two rails and flexing the connector clip to cause the rails to spread apart slightly until their flanges release from the free edges 28F of the frame sections. Once that has occurred, the connector clip can be pulled away and removed from the frame sections. Once the connector clip 30 has been removed from the frame sections, it can be used as a tool to disconnect the bulletin board assemblies 22A and 22B from each other. In particular, the tab 30F of the connector clip 30 can be inserted into the slot 24F of the corner node connector 24 of bulletin board assembly 22A and pressing upon the flange 26F in that slot to free the upper tab 26B of the corner node snap connector 26 from the corner node connector 24 of the bulletin board assembly 22A. In a similar manner, the tab 30F of the connector clip 30 can be inserted into the slot 24F of the corner node connector 24 of bulletin board assembly 22B and pressing upon the flange 26F in that slot to free the lower tab 26B of the corner node snap connector 26 from the corner node connector 24 of the bulletin board assembly 22.

When the bulletin board assemblies 22A and 22B have been connected together in their desired orientation, e.g., assembly 22A being located vertically above assembly 22B as shown in FIGS. 1 and 2, the assembled unit can then be mounted on a wall (not shown). That can be accomplished through use of the wall mount clips 32. Each wall mount clip is formed any suitable material, e.g., metal or plastic, and can be formed as an extrusion or by molding. In any case each wall mount clip basically comprises a thin planar member having a rear surface 32A, a front surface 32B, and a tab 32C projecting perpendicularly to the front surface along a side edge of the clip as best seen in FIGS. 2B and 7. The free end of the tab is in the form of a flange 32D having a sloped outer surface. The flange includes plural holes 32E. The holes are configured to receive respective screws 40 to mount the clip on the wall via conventional wall anchors 42. When the clip is mounted on the wall the tab 32C projects outward. The tab is configured and sized so that its tab and the portion of the clip contiguous with the tab can flex outward as the sloped surface rides over the edge of the channel 24D located in a vertical side of the associated corner node, whereupon its flange 32 snaps within that channel 24D.

In the example of the system 20 shown in FIGS. 1 and 2, the two upper corner nodes 34 of the assembly 22A are each connected to a respective clip 32 mounted on the wall. The mounting of the clip 32 on the wall is accomplished using the screws and wall anchors (if necessary). Once the clips 32 are in place the unit composed of the connected panel assemblies 22A and 22B is juxtaposed so that the entryways of the channels 24D contiguous with the vertically extending side edges of the corner nodes 24 in the upper right and left corners of the assembly 22A are aligned with the tabs 32C of the two wall-mounted clips. The unit is then pushed against those clips to cause the tabs and contiguous portions to flex, whereupon the sloped surfaces of the flange on each tab slides over the portion of the corner node 24 contiguous with the channel 24D until the flange enters the channel and snaps back (un-flexes) into its normal shape, thereby locking the clip to the corner node.

Removal of the assemblies 22A and 22B from the wall, if desired, can be readily accomplished by flexing the tabs of the clips so that they are released from the channels in which they are located, whereupon the unit made up of the assemblies 22A and 22B can be removed from the wall.

It should be noted that if desired one may use two additional wall mount clips 32 in addition to the clips 32 in the upper left and right corners of the bulletin board assembly 22A to mount that system on the wall. In such a case, the additional two clips are used to connect the lower left and lower right corners of the bulletin board assembly 22B to the wall. In fact, in lieu of using any clips 32 to mount the assemblies 22A and 22B on the wall, one can use the heretofore mentioned wall mount adhesive pads 34.

Figure 2D:
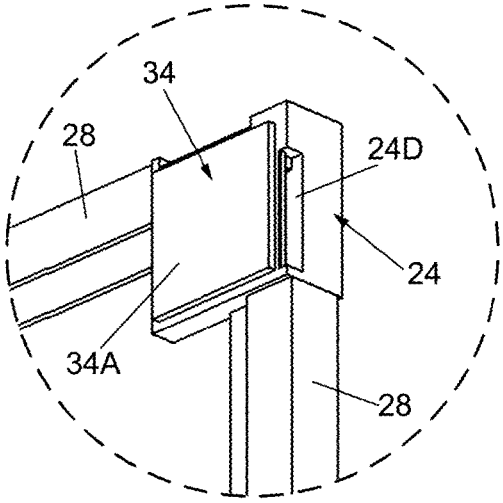
FIG. 2D is an enlarged isometric view of the portion of the bulletin board system showing an alternative means, e.g., an adhesive pad, for mounting the system on a wall in lieu of the wall mount clip shown in FIG. 2B.

One such pad is shown in FIG. 2D. That pad basically comprises a thin planar member having an adhesive inner surface which is configured to be secured to the back surface 24E of a corner node. The pad includes an outer surface 34A which is in the form of a self-stick adhesive of suitable strength to hold the assembled system 20 on the wall. The adhesive on the outer surface is preferably covered with a removable liner sheet (not shown) for protecting the adhesive until the mounting pad is ready for use. To that end, when the system 20 is configured for use with the adhesive mounting pads 34 instead of the mounting clips 32 is ready to be mounted on the wall the liner sheets are removed from the mounting pads on the corner nodes in the upper right and upper left corners of the bulletin board assembly 22A to thereby expose the adhesive surfaces 34A of those pads. Then the unit composed of the two connected bulletin board assemblies 22A and 22B is pushed against the wall so that the exposed adhesive surfaces engage the wall. This action completes the mounting of the unit on the wall. It should be pointed out at this juncture that in lieu of using a self-stick adhesive as the outer surface 34A of the mounting pads 34, the outer surface of those mounting may be in the form of a VELCRO® connector patch (or any other commercially available multi-hook type or the multi-loop type connector patch), for releasable engagement with a cooperating VELCRO® patch on the wall or other static structure on which the bulletin board system of this invention is to be mounted.

Turning now to FIGS. 10 and 11 there is shown another bulletin board system 120 constructed in accordance with this invention. The system 120 is identical to the system 20 except for the shape of the two bulletin board assemblies which make it up, i.e., they are of different shapes. In the interest of brevity the components making up the system 120 which are identical to the components making up the system 20 will be given the same reference numbers as those of the system 20 and their function and operation will not be reiterated. Thus, the system 120 shown in FIGS. 10 and 11 comprises a bulletin board assembly 122A and a bulletin board assembly 22B. The assembly 122A is identical to the assembly 22A except for the shape of its panel 136. In particular, the panel 136 is of rectangular shape, e.g., 12 inches by 16 inches, whereas the panel 36 is of square shape, e.g., 16 inches by 16 inches. However, like the panel 36, the panel 136 is made up of a base layer 36A and a face layer 36B. The frame making up the bulletin board assembly 122A includes four frame sections 28, but the horizontal frame sections 128A at the upper and lower edges of the assembly 122A are shorter in length, e.g., 12 inches, than the corresponding frame sections of the assembly 22B. Otherwise the frame sections 128A are identical in construction to the frame sections 28A. The frame sections of the assembly 122A are connected together by four corner nodes 24.

As best seen in FIG. 11 the bulletin board assembly 122A is connected to the bulletin board assembly 22B by the corner node 24 at the lower left corner of the assembly 122A being connected to the corner node 24 at the upper left corner of the assembly 22B. The connection of those two corner nodes is accomplished by means of the corner node snap connector 26 as described above. The corner node 24 at the lower right corner of the assembly 122A is not connected to the corner node 24 at the upper right corner of the assembly 22B since the assembly 122A is narrow in width than the assembly 22B. However, the lower frame section 128 of the assembly 122A is connected to the upper frame section 28 of the assembly 22B by means of the two connector clips 30, like that described heretofore.

The mounting of the unit formed by the connection of the bulletin board assemblies 122A and 22B together on the wall is accomplished by use of two wall mount clips 32 which are mounted on the wall. The clips 32 are spaced apart on the wall so that they engage the channels 24D contiguous with the vertical sides of the corner nodes 24 forming the upper left and upper right corners of the bulletin board assembly 122A. If desired, the system 120 may make use of two other wall mount clips 32, like shown in FIG. 11, to secure the lower left and lower right corners of the bulletin board assembly 22B to the wall. It should be noted that if desired the adhesive pads 34 can be used in lieu of the mounting clips 32 to mount the system 120 onto the wall.

Figure 12:
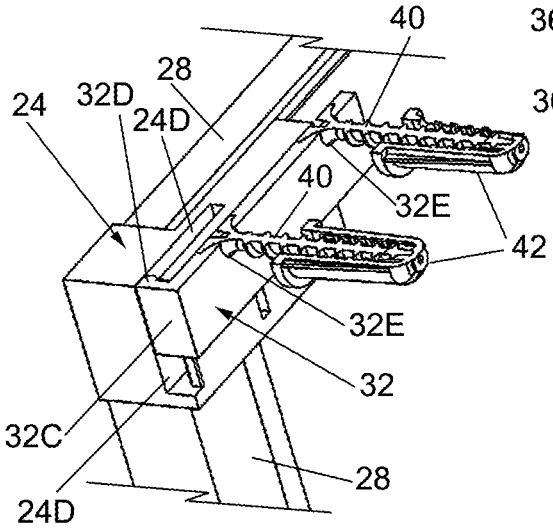
FIG. 12 is an enlarged isometric view, partially in section, of the wall mounting clip shown in FIG. 11B
Figure 13:
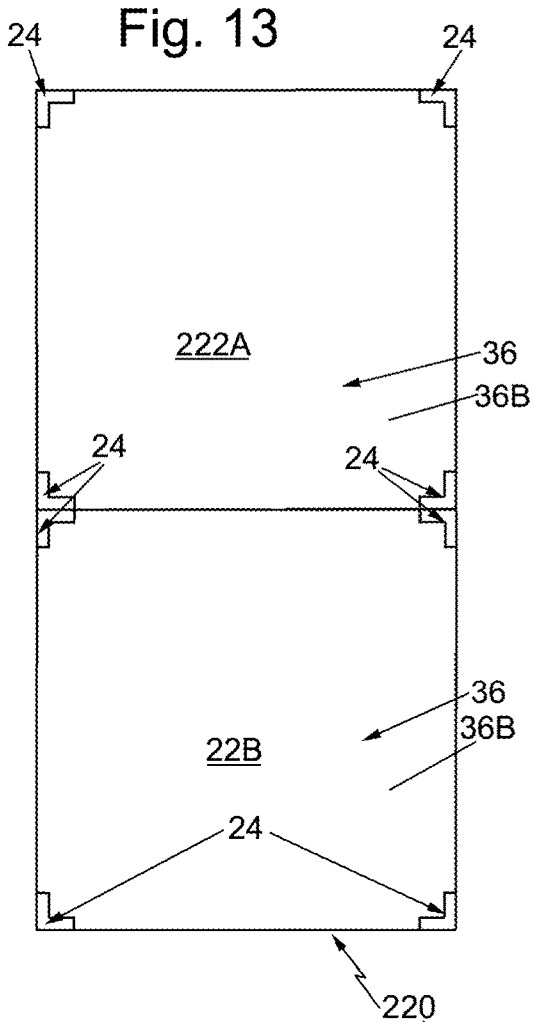
FIG. 13 is a front elevation view of another exemplary embodiment of a bulletin board system constructed in accordance with this invention, the bulletin board system making use of two identically sized unframed bulletin board assemblies.
Figure 14:
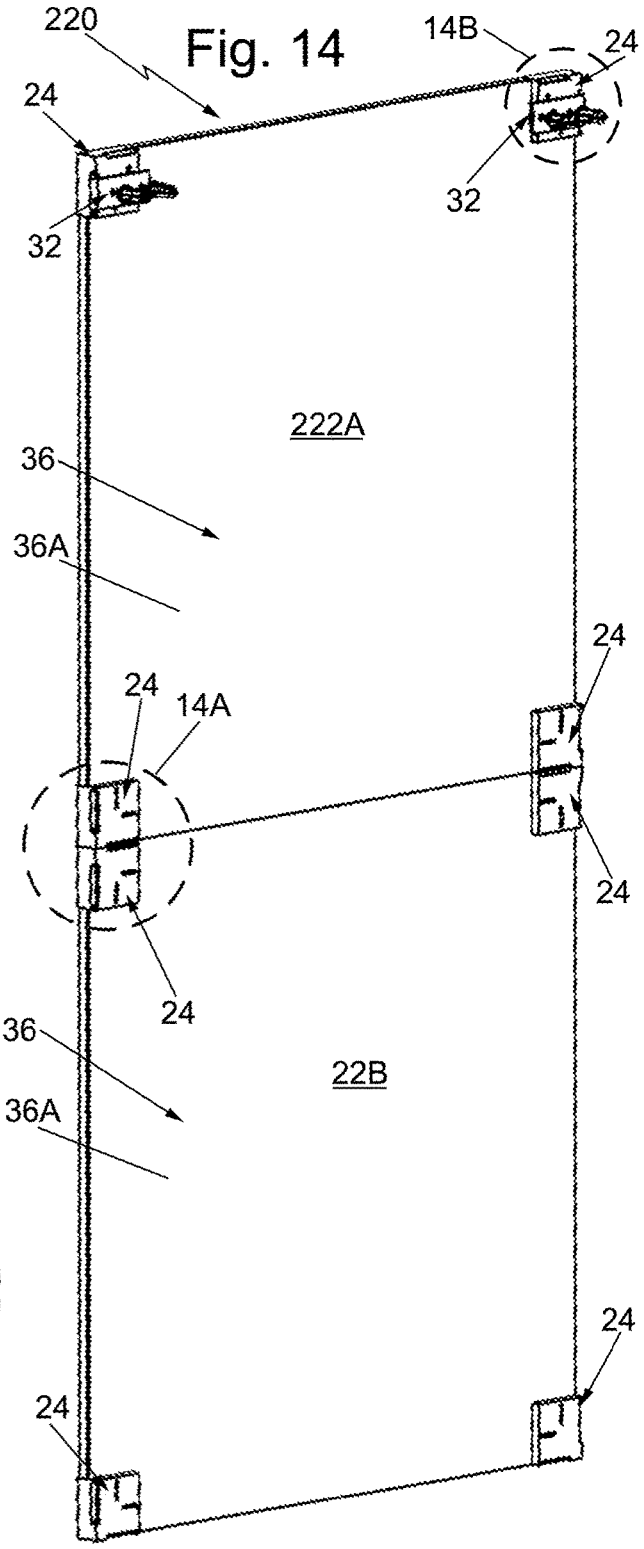
FIG. 14 is an enlarged isometric view of the rear side of the bulletin board system shown in FIG. 13, showing the bulletin board system as it would be mounted on a wall using wall mount clips forming a portion of the system.
Figure 15:
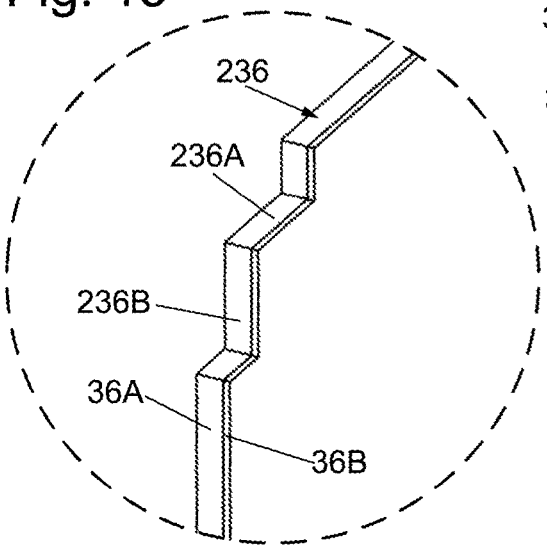
FIG. 15 is an enlarged isometric view of a portion of a bulletin board component forming a portion of the system of FIG. 13.
Figure 14A:
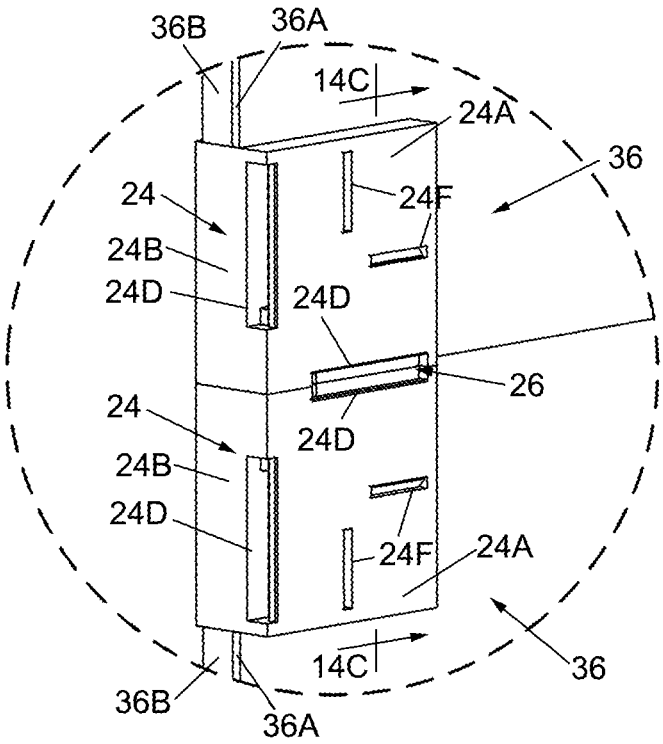
FIG. 14A is an enlarged isometric view of the portion of the bulletin board system shown within the broken circle designed by the reference number 14A in FIG. 14.
Figure 14B:
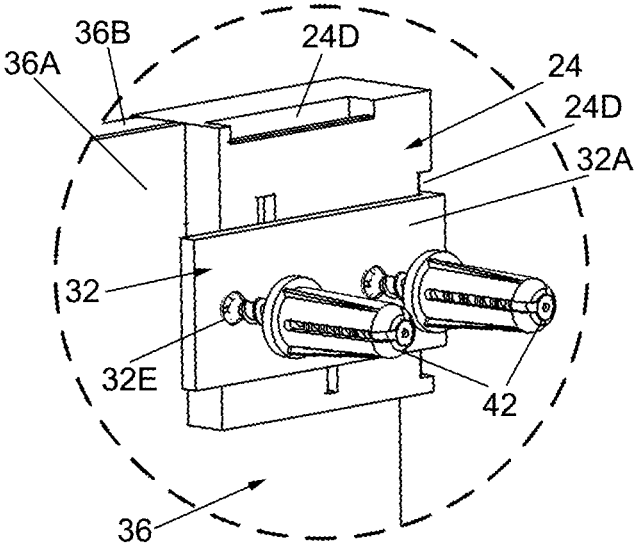
FIG. 14B is an enlarged isometric view of the portion of the bulletin board system shown within the broken circle designed by the reference number 14B in FIG. 14.
Figure 14C:
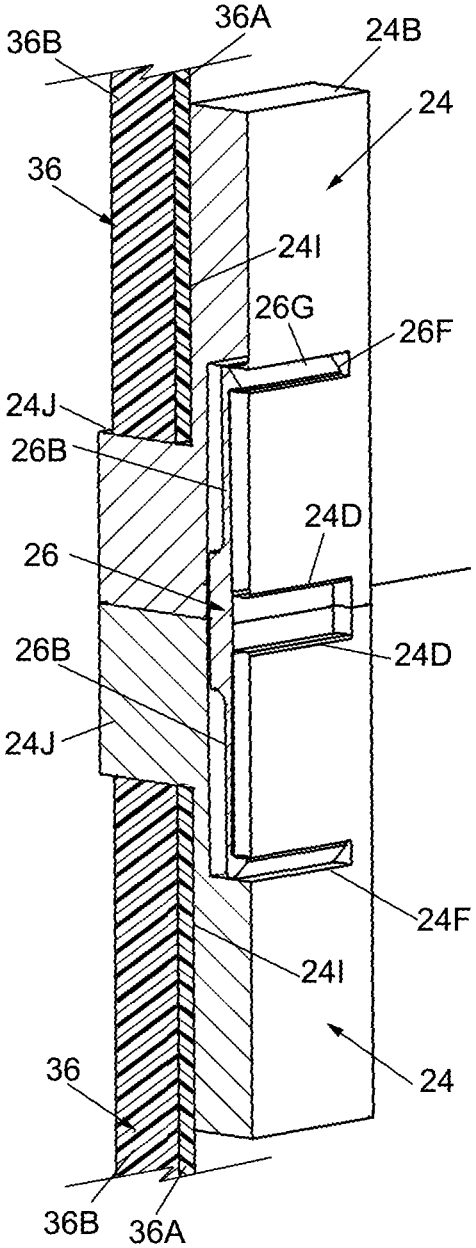
FIG. 14C is an enlarged sectional isometric view taken along line 14C-14C of FIG. 14.

Turning now to FIGS. 13-15, there is shown another bulletin board system 220 constructed in accordance with this invention. The system 220 is identical to the system 20 except that each of the bulletin board assemblies is frameless, i.e., does not include any frame sections. In the interest of brevity the components making up the system 220 which are identical to the components making up the system 120 will be given the same reference numbers as those of the system 120 and a description of their function and operation will not be reiterated. Thus, the system 220 shown in FIGS. 11 and 12 comprises a bulletin board assembly 222A and a bulletin board assembly 222B. The assembly 222A basically comprises a panel 136 (FIG. 15) made up of a base layer 36A and a face layer 36B and is rectangular in shape like the panel 136, but each of its corners is notched. In particular, each corner includes a horizontally extending notch 236A and a vertically extending notch 236B. The notches conjoin to receive a respective corner node 24 therein. In particular the horizontal notch 236A receives the horizontal ledge surface 24J of the corner node and the vertical notch 236B receives the vertical ledge surface 24J of that corner node. The corner node 24 is adhesively secured, e.g., epoxied, within those notches. Each of the four corners of the panel 236 includes a respective corner node 34 adhesively secured, e.g., epoxied, thereto to complete the bulletin board assembly 222A.

The bulletin board assembly 222B is identical in construction to the assembly 222A and is connected to that assembly as described above with respect to the system 20, except that no connector clips 30 are used since the assemblies 222A and 222B are frameless.

Once the assemblies 222A and 22B are assembled together using the corner node snap connectors 26, the assembled unit can be mounted on the wall using the wall clips 32, like those disclosed above with respect to the system 20. Alternatively, that assembled unit can be mounted on the wall by use of the adhesive mount pads 34, like those disclosed above with respect to the system 20.

It should be pointed out at this juncture that the systems and components as described above are merely exemplary and thus other components can be used in the systems. For example, the corner nodes need not be of square shape so long as they include channels oriented perpendicularly to each other for receipt of flexible tabs of a snap connector. Moreover, that snap connector need not be constructed like that shown so long as it includes a pair of portions which extend in opposite directions and which can be readily secured and snap fit within the channels. Further for framed bulletin board systems, the frame section need not be constructed like that shown and described above so long as they are constructed to be connected to the corner nodes to enclose the bulletin board panel. Each of the panels making up the bulletin board assemblies of this invention includes an outer surface. That surface comprises of at least one of a cork panel, a dry erasable material panel, a chalk receiving material panel, a mirror panel, a panel formed of a material capable of being written upon, a panel bearing some indicia or graphics, a panel formed of a fabric, and a panel formed metal capable of having a magnetic item releasably mounted thereon. Those types of panels are merely exemplary and thus the panels making up the bulletin board assemblies of this invention are not limited to those materials. In fact, many other changes and variations to the systems and components of the systems of this invention are contemplated, and thus the exemplary systems and components as described above should not be deemed limiting.

As should be appreciated by those skilled in the art from the foregoing the systems of this invention offer great latitude in allowing one to configure a wall organization system, such as but not limited to a bulletin board system, to a user's desires, whether it includes a single board assembly or plural board assemblies. Moreover any number of board assemblies can be connected together either in a horizontal or vertical orientation or in a mixed orientation of horizontal and vertical. Thus, each board assembly of this invention can be configured to be connected to another board assembly utilizing two corner nodes which are snap connected together in either the vertically or horizontally positions. This procedure can be repeated in either the vertical or horizontal direction using multiple boards. For example, to connect different size board assemblies together, attach two corner node snap connectors to the corner nodes 24 of a first board assembly. Then, connect the second board assembly to either corners of the first board assembly using the corner node snap connectors 26. Then connect the adjoining frames 28 using the connector clips 30. This procedure can be repeated to either the vertical or horizontal frames using multiple different size boards. There are two options to hang board(s) on a wall. The first option makes use of the wall mount clips 32. To that end, two holes are drilled into the wall that will mount the system, ensuring that the holes are properly spaced for the particular size board assembly. Then, if desired or necessary, conventional wall anchors 42 are inserted into the holes. The wall mounting clips 32 are then screwed into the wall anchors by screws 40 to mount the clips on the wall. Then the assembled board unit is snapped onto the wall mount clips. This procedure can be repeated in any direction. The second option entails using the pre-applied adhesive pads on the corner nodes. To that end, the protective liner on the adhesive pad each of the corner nodes adhesive pads is removed to expose the adhesive. A level line is then marked on the wall to which the system will be mounted and the assembled unit of the bulletin board assemblies is lined up with that level line and the adhesive pads are then pressed into engagement with the wall. This procedure can be repeated in any direction with multiple boards.

Without further elaboration the foregoing will so fully illustrate our invention that others may, by applying current or future knowledge, adopt the same for use under various conditions of service.

We claim:

1. A modular wall organization system for mounting on a wall, said modular wall organization system comprising:

a first board component comprising a first planar panel having plural corners;

a second board component comprising a second planar panel having plural corners;

a first corner node member located at one of said plural corners of said first planar panel, said first corner node member comprising a body having a back surface, a first side edge, a second side edge, a first channel, and a second channel, said first side edge of said first corner node member extending at a predetermined angle to said second side edge of said first corner node member, said first channel of said first corner node member extending into said body of said first corner node member from said first side edge of said first corner node member, said second channel extending into said body of said first corner node member from said second side edge of said first corner node member;

a second corner node member located at one of said plural corners of said second planar panel, said second corner node member comprising a body having a back surface, a first side edge, a second side edge, a first channel, and a second channel, said first side edge of said second corner node member extending at a predetermined angle to said second side edge of said second corner node member, said first channel of said second corner node member extending into said body of said second corner node member from said first side edge of said second corner node member, said second channel of said second corner node member extending into said body of said second corner node member from said second side edge of said second corner node member; and at least one snap-connector having a first extending portion and a second extending portion, said first extending portion being configured for snap-fitting into one of said first and second channels of said first corner node member, said second extending portion being configured for snap-fitting into one of said first and second channels of said second corner node member to secure said first corner node member to said second corner node member.

2. The modular wall organization system of claim 1, wherein said first corner node member additionally comprises a first slot and a second slot, wherein said second corner node member additionally comprises a first slot and a second slot, wherein said first slot of said first corner node member is located in said back surface of said first corner node member and in communication with said first channel of said first corner node member, wherein said second slot of said first corner node member is located in said back surface of said first corner node member and in communication with said second channel of said first corner node member, wherein said first slot of said second corner node member is located in said back surface of said second corner node member and in communication with said first channel of said second corner node member, and wherein said second slot of said second corner node member is located in said back surface of said second corner node member and in communication with said second channel of said second corner node member.

3. The modular wall organization system of claim 2, wherein said at least one snap connector includes one flexible tab having a flanged free end and another flexible tab having a flanged free end, wherein said one flexible tab is configured for receipt in said first channel of said first corner node member with said flanged free end of said one flexible tab being located in said first slot of said first corner node member, and wherein said other flexible tab is configured for receipt in said first channel of said second corner node member with said flanged free end of said other flexible tab being located in said first slot of said second corner node member.

4. The modular wall organization system of claim 3, wherein said at least one snap connector includes one flexible tab having a flanged free end and another flexible tab having a flanged free end, wherein said one flexible tab is configured for receipt in said second channel of said first corner node member with said flanged free end of said one flexible tab being located in said second slot of said first corner node member, and wherein said other flexible tab is configured for receipt in said second channel of said second corner node member with said flanged free end of said other flexible tab being located in said second slot of said second corner node member.

5. The modular wall organization system of claim 4, wherein at least one of the first and second panel includes an outer surface comprises of at least one of a cork panel, a dry erasable material panel, a chalk receiving material panel, a mirror panel, a panel formed of a material capable of being written upon, a peg board panel, a panel bearing some indicia or graphics, a panel formed of a fabric, and a panel formed metal capable of having a magnetic item releasably mounted thereon.

6. The modular wall organization system of claim 2, wherein said at least one snap connector includes one flexible tab having a flanged free end and another flexible tab having a flanged free end, wherein said one flexible tab is configured for receipt in said second channel of said first corner node member with said flanged free end of said one flexible tab being located in said second slot of said first corner node member, and wherein said other flexible tab is configured for receipt in said second channel of said second corner node member with said flanged free end of said other flexible tab being located in said second slot of said second corner node member.

7. The modular wall organization system of claim 2, wherein at least one of the first and second panel includes an outer surface comprises of at least one of a cork panel, a dry erasable material panel, a chalk receiving material panel, a mirror panel, a panel formed of a material capable of being written upon, a peg board panel, a panel bearing some indicia or graphics, a panel formed of a fabric, and a panel formed metal capable of having a magnetic item releasably mounted thereon.

8. The modular wall organization system of claim 1, additionally comprising a clip for securement to the wall to mount said bulletin board system thereon, said clip being configured for engagement with one of said first and second corner node members.

9. The modular wall organization system of claim 8, wherein said clip includes a flexible tab having a flanged free end configured for snap-fitting receipt in one of said first or second channels of one of said first and second corner node members.

10. The modular wall organization system of claim 1, additionally comprising an adhesive or VELCRO® pad for securement to the wall to mount said bulletin board system thereon, said adhesive or VELCRO® pad being configured for securement to said back surface of said body of one of said first and second corner node members.

11. The modular wall organization system of claim 1, wherein said first bulletin board additionally comprises a first frame, and said second bulletin board additionally comprises a second frame.

12. The modular wall organization system of claim 11, wherein said first frame includes two sections which are connected together by said first corner node, and wherein said second frame includes two sections which are configured to be connected together by said second corner node member.

13. The modular wall organization system of claim 12, wherein each of said sections of said first frame includes a hollow end, wherein said first corner node member comprises a pair of projections configured to be received within respective ones said hollow ends of said sections of said first frame, wherein each of said sections of said second frame includes a hollow end, and wherein said second corner node member comprises a pair of projections configured to be received within respective ones said hollow ends of said sections of said second frame.

14. The modular wall organization system of claim 13, wherein at least one of the first and second panel includes an outer surface comprises of at least one of a cork panel, a dry erasable material panel, a chalk receiving material panel, a mirror panel, a panel formed of a material capable of being written upon, a peg board panel, a panel bearing some indicia or graphics, a panel formed of a fabric, and a panel formed metal capable of having a magnetic item releasably mounted thereon.

15. The modular wall organization system of claim 12, wherein at least one of the first and second panel includes an outer surface comprises of at least one of a cork panel, a dry erasable material panel, a chalk receiving material panel, a mirror panel, a panel formed of a material capable of being written upon, a peg board panel, a panel bearing some indicia or graphics, a panel formed of a fabric, and a panel formed metal capable of having a magnetic item releasably mounted thereon.

16. The modular wall organization system of claim 11, wherein at least one of the first and second panel includes an outer surface comprises of at least one of a cork panel, a dry erasable material panel, a chalk receiving material panel, a mirror panel, a panel formed of a material capable of being written upon, a peg board panel, a panel bearing some indicia or graphics, a panel formed of a fabric, and a panel formed metal capable of having a magnetic item releasably mounted thereon.

17. The modular wall organization system of claim 11, additionally comprising a connector clip configured for releasably connecting said first frame to said second frame, said connector clip comprising a thin planar body from which a pair of flanged rails project, one of said flanged rails being configured for snap-fitting engagement with a respective portion of said first frame, the other of said flanged rails being configured for snap-fitting engagement with a respective portion of said second frame.

18. The modular wall organization system of claim 17, wherein said connector clip comprises a tab projecting outward from a side thereof, said tab being configured to serve as a tool for disconnecting said first corner node from said second corner node.

19. The modular wall organization system of claim 1, wherein at least one of the first and second panel includes an outer surface comprises of at least one of a cork panel, a dry erasable material panel, a chalk receiving material panel, a mirror panel, a panel formed of a material capable of being written upon, a peg board panel, a panel bearing some indicia or graphics, a panel formed of a fabric, and a panel formed metal capable of having a magnetic item releasably mounted thereon.

20. A modular wall organization system configured to be mounted on a wall of a structure, said modular wall organization system comprising a first board assembly and a second board assembly, said first board assembly comprising:

a first planar panel having plural corners;

a first frame assembly comprising plural first elongated frame sections, and plural first corner node members, each of said plural first corner node members including a pair of projections, said plural first corner node members being configured for connecting said plural first elongated frame sections to one another to form a first frame surrounding said first planar panel, each of said plural first elongated frame sections having an opposed pair of hollow ends configured to receive a respective projection of said pair of projections of a respective one of said plural first corner node members, at least one of said plural first elongated frame sections including a first flange, said first flange being configured to mount a clip thereon, wherein each of said first corner node members comprises a body having a back surface, a first side edge, a second side edge, a first channel, and a second channel, said first side edge of said first corner node member extending at a predetermined angle to said second side edge of said first corner member, said first channel of said first corner node member extending into said body of said first corner member from said first side edge of said first corner member, said second channel extending into said body of said first corner member from said second side edge of said first corner member;

said second board assembly comprising:

a second planar panel having plural corners; and a second frame assembly comprising plural second elongated frame sections, and plural second corner node members, each of said plural second corner node members including a pair of projections, said plural second corner node members being configured for connecting said plural second elongated frame sections to one another to form a second frame surrounding said second planar panel, each of said plural second elongated frame sections having an opposed pair of hollow ends configured to receive a respective projection of said pair of projections of a respective one of said plural second corner node members, at least one of said plural second elongated frame sections including a second flange, said second flange being configured to mount a clip thereon;

said second board assembly being configured to be connected to said first board assembly by a snap-connector connecting one of said plural first corner node members to one of said plural second corner node members.

21. The modular wall organization system of claim 20, wherein said at least one snap connector includes one flexible tab having a flanged free end and another flexible tab having a flanged free end, wherein said one flexible tab is configured for receipt in said first channel of said first corner node member with said flanged free end of said one flexible tab being located in said first slot of said first corner node member, and wherein said other flexible tab is configured for receipt in said first channel of said second corner node member with said flanged free end of said other flexible tab being located in said first slot of said second corner node member.

22. The modular wall organization system of claim 20, wherein said at least one snap connector includes one flexible tab having a flanged free end and another flexible tab having a flanged free end, wherein said one flexible tab is configured for receipt in said second channel of said first corner node member with said flanged free end of said one flexible tab being located in said second slot of said first corner node member, and wherein said other flexible tab is configured for receipt in said second channel of said second corner node member with said flanged free end of said other flexible tab being located in said second slot of said second corner node member.

23. The modular wall organization system of claim 21, wherein said at least one snap connector includes one flexible tab having a flanged free end and another flexible tab having a flanged free end, wherein said one flexible tab is configured for receipt in said second channel of said first corner node member with said flanged free end of said one flexible tab being located in said second slot of said first corner node member, and wherein said other flexible tab is configured for receipt in said second channel of said second corner node member with said flanged free end of said other flexible tab being located in said second slot of said second corner node member.

* * * * *